US011628970B2

(12) United States Patent
Steibert et al.

(10) Patent No.: US 11,628,970 B2
(45) Date of Patent: Apr. 18, 2023

(54) PALLET COLLAR, A PALLET COLLAR SYSTEM AND USE THEREOF

(71) Applicant: NEFAB AB, Jönköping (SE)

(72) Inventors: Mattias Steibert, Ekolsund (SE); Qinxin Lu, Shanghai (CN); David Nowak, Hasselt (BE); Andreas Pihl, Hong Kong (CN)

(73) Assignee: NEFAB AB, Jönköping (SE)

( * ) Notice: Subject to any disclaimer, the term of this patent is extended or adjusted under 35 U.S.C. 154(b) by 0 days.

(21) Appl. No.: 17/556,135

(22) Filed: Dec. 20, 2021

(65) Prior Publication Data

US 2022/0227528 A1 Jul. 21, 2022

(30) Foreign Application Priority Data

Jan. 18, 2021 (SE) ..... 2150043-4

(51) Int. Cl.
*B65D 19/20* (2006.01)

(52) U.S. Cl.
CPC .... *B65D 19/20* (2013.01); *B65D 2519/00159* (2013.01); *B65D 2519/00194* (2013.01); *B65D 2519/00502* (2013.01); *B65D 2519/00537* (2013.01)

(58) Field of Classification Search
CPC ..... B65D 19/20; B65D 2519/00159; B65D 2519/00502; B65D 2519/00537
USPC ..... 206/600, 386
See application file for complete search history.

(56) References Cited

U.S. PATENT DOCUMENTS

| | | | | |
|---|---|---|---|---|
| 4,331,234 | A * | 5/1982 | Gilbert | B65D 19/20 206/320 |
| 4,609,116 | A * | 9/1986 | Simms | B65D 9/12 217/69 |
| 5,474,230 | A * | 12/1995 | Yotukura | B65D 5/6605 229/199 |
| 6,299,011 | B1 * | 10/2001 | Rosenfeldt | B65D 19/0028 16/388 |
| 8,668,133 | B2 * | 3/2014 | Moehlig | 229/199 |
| 2006/0118456 | A1 * | 6/2006 | Macasaet | B65D 19/18 206/386 |
| 2011/0308993 | A1 * | 12/2011 | Hill | B65D 19/20 493/122 |

FOREIGN PATENT DOCUMENTS

| | | | |
|---|---|---|---|
| DE | 202015106316 | U1 | 12/2015 |
| JP | 1995-309342 | A | 11/1995 |
| SE | 528630 | C2 | 1/2007 |
| WO | 2018/063046 | A1 | 4/2018 |

* cited by examiner

*Primary Examiner* — Jacob K Ackun
(74) *Attorney, Agent, or Firm* — Dilworth & Barrese, LLP

(57) ABSTRACT

A pallet collar which is a casing structure, generally having four walls interconnected to form a rectangular frame, and used for providing a pallet with walls enclosing a loading space thereof, to hold and protect goods placed on the pallet during storage and/or transport.

15 Claims, 6 Drawing Sheets

PALLET COLLAR, A PALLET COLLAR SYSTEM AND USE THEREOF

TECHNICAL FIELD OF THE INVENTION

The present invention relates to a pallet collar for storing, packaging and transporting goods, usually on a pallet, as well as a pallet collar system with a plurality of such pallet collars, and use of such a pallet collar or pallet collar system.

The invention relates especially to a pallet collar intended to be used within the field of commercial logistics. Such a pallet collar is a casing structure, generally consisting of four walls interconnected to form a rectangular frame. This is used for providing a pallet with walls enclosing a loading space thereof, to hold and protect goods placed on the pallet during storage and/or transport.

Such a pallet collar may be used independently, or together with a bottom member and/or lid creating a box-like structure. It may also be provided with partitioning walls dividing the loading space into several smaller compartments and a plurality of pallet collars may be arranged on top of each other to increase the height of the crate, with bottom members therebetween creating several compartments on top of each other, or without such members for creating one large loading space. Even though use on a pallet, especially a pallet having standard dimensions as defined by EUR, ISO or GMA, is the by far most common use of a such a pallet collar, this may of course also be used without a pallet, or on a pallet having other shapes and dimensions, such as with a square loading surface.

BACKGROUND ART

Pallet collars of this type can be divided into three general categories. Pallet collars made of wood is the oldest and still most commonly used type. These are strong but heavy and cumbersome to handle. Another type is plastic pallet collars, which may be made as strong as those of wood but with a lower weight. Plastic pallet collars are however expensive and not environmentally friendly.

The present invention relates especially to disposable pallet collars, which are used for instance by transports of products from a manufacturer to a store, where the products are unloaded and the pallet collars disposed for being recycled. Such pallet collars must of course be inexpensive to manufacture and are therefore generally made of paper-based materials, such as corrugated cardboard. Such pallet collars already known are not strong enough to ensure protection of expensive and/or fragile goods. These are therefore often transported by means of pallet collars of wood or plastic, which are expensive solutions if the collars are not returned and this can be troublesome or inappropriate in some cases, for instance in the case of a single order and delivery to a customer.

There is thus a gap in the supply of pallet collars currently available on the market and a need for new products able to fill this gap. More specifically, there is a need for a pallet collar which can be produced at a low cost and has a low weight while at the same time providing a strong protection for the goods to be stored and/or transported therein.

There is a constant strive for improving products of this type due to the ever increasing need for transportation of goods and the fact that logistics becomes an increasingly important part of the value chain of a product. Even a small improvement in this area which slightly reduces transportation costs could have a significant impact on the profit margin of the product and generate a competitive advantage.

SUMMARY OF THE INVENTION

The object of the present invention is to provide a pallet collar of the type defined in the introduction being improved in at least some aspect with respect to such pallet casing assemblies already known.

This object is according to the invention obtained by providing a pallet collar according to the description herein.

More specifically, the design of the pallet collar walls, with a double wall structure which is reinforced at the center by the third and fourth parts, has proven to create a pallet collar with a strength and ability to absorb forces applied both vertically and horizontally comparable to that of a pallet collar of wood or plastic, while the production cost and weight thereof are rather comparable to those of a regular corrugated cardboard collar thanks to the inventive folding structure of the walls enabling the use of a paper-based material without downgrading the strength of the finished pallet collar.

According to an embodiment of the invention each first and third part has a width measured between its two adjacent folding lines being 2-7 times the thickness of the sheet, more preferably 3-6 times the thickness of the sheet, most preferably 4-5 times the thickness of the sheet.

According to another embodiment of the invention each fourth part has a width, extending in the direction of the extension of said main folding lines, being at least 2 times, at least 3 times, preferably at least 4 times the width of each first and third part measured between its two adjacent folding lines.

According to another embodiment of the invention the second parts of each pallet collar wall extends into contact with each other at the center of the pallet collar wall.

According to another embodiment of the invention at least one first part of each pallet collar wall has a length which is smaller than the length of the mid part of that pallet collar wall and is centered along the length of the mid part so that the ends of said first part are located at a distance from the ends of the mid part to which it is connected, creating an opening into a space between the inner and outer wall portions in each corner of the top and/or bottom edge of the pallet collar walls, defined by the first parts, in an assembled state of the pallet collar, so as to allow insertion of a separate element into said space at said corners of the pallet collar.

According to another embodiment of the invention each first part of each pallet collar wall has a length which is smaller than the length of the mid part of that pallet collar wall and is centered along the length of the mid part so that the ends of each first part are located at a distance from the ends of the mid part to which it is connected, creating a said opening in each corner of the top and bottom edge of the pallet collar walls, in the assembled state of the pallet collar, so as to allow a separate element to project through the pallet collar at each corner thereof.

According to another embodiment of the invention the paperbased sheet is a fiberboard sheet.

According to another embodiment of the invention the fiberboard sheet is a corrugated cardboard sheet.

According to another embodiment of the invention the flutes of the corrugated cardboard sheet extend in the direction of the extension of said main folding lines.

According to another embodiment of the invention the flutes of the corrugated cardboard sheet extend perpendicularly to the direction of the extension of said main folding lines.

According to another embodiment of the invention each fourth part is secured to the mid part of the same pallet collar wall by adhesive, preferably a vinyl acetate polymer based glue.

According to another embodiment of the invention the pallet casing is a disposable pallet casing.

The invention also relates to a pallet collar system comprising at least two pallet collars according to the present invention as well as at least one elongated corner element, and use of a pallet collar and/or pallet collar system according to the present invention according to the appended independent claims thereof.

The features of and advantages with such a system and use will be clear and further advantages as well as advantageous features of the pallet collar of the invention appear from the following description of a pallet collar and pallet collar system according to embodiments of the invention.

BRIEF DESCRIPTION OF THE DRAWINGS

With reference to the appended drawings, below follows a specific description of embodiments of the invention cited as examples.

In the drawings.

DETAILED DESCRIPTION OF EMBODIMENTS OF THE INVENTION

Figure 3:
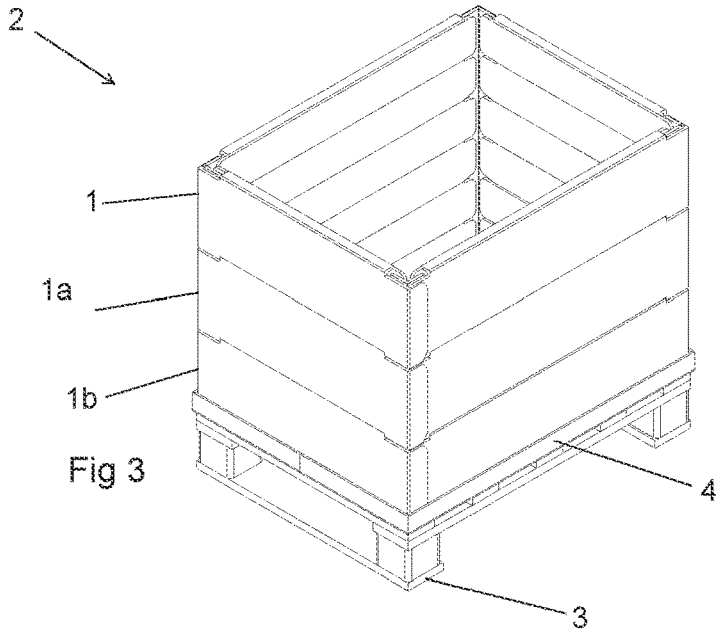
FIG. 3 is a perspective view from above of a pallet collar system according to an embodiment of the invention, comprising three pallet collars as shown in FIG. 1, in an assembled state standing on a pallet.
Figure 4:
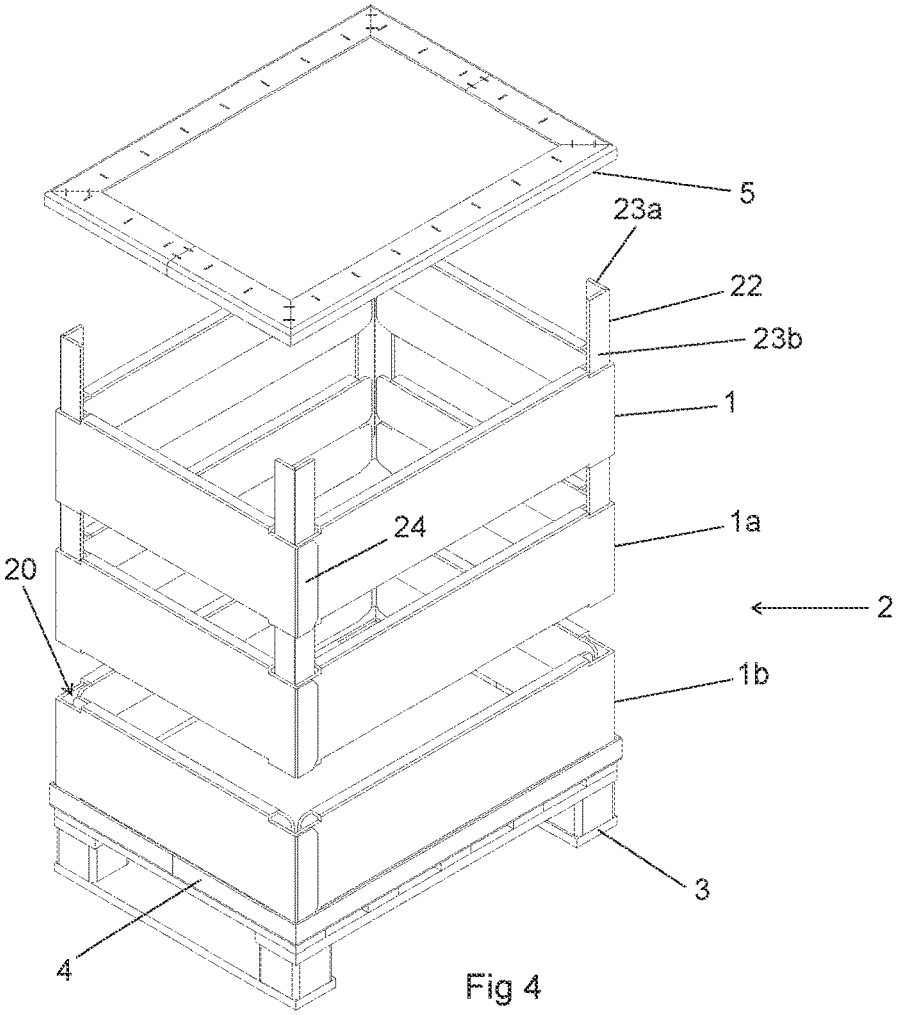
FIG. 4 is a partly exploded perspective view of the pallet collar system shown in FIG. 3, further provided with a lid.

A pallet collar 1 according to an embodiment of the invention is illustrated in the appended FIGS. 1-8. FIG. 9 shows a comparison between the bulging and bending strengths of the pallet collar 1 according to two different embodiments of the invention with three pallet collars forming part of the prior art. The FIGS. 3-4 show the pallet collar as a component of a pallet collar system 2 according to an embodiment of the invention. The pallet collar 1 and pallet collar system 2 will now be described while at the same time making reference to all these figures.

The pallet collar 1 is a disposable pallet collar intended to be used within the field of commercial logistics, such as for keeping and protecting products loaded on a pallet 3 during a single transport from a manufacturer to a store, whereafter it is discarded for recycling. Such a pallet collar may be used independently, i.e. placed directly on the pallet and have an open top side, or together with a bottom member 4 and lid 5 creating a box-like structure fully enclosing the goods on the pallet. The pallet collar typically has outer dimensions corresponding to those of the upper loading surface of a pallet with standard dimensions as defined by EUR, ISO or GMA, however the pallet collar according to the invention may also have other dimensions, such as be customized to suit the packaging and transport of a specific product.

Figure 1:
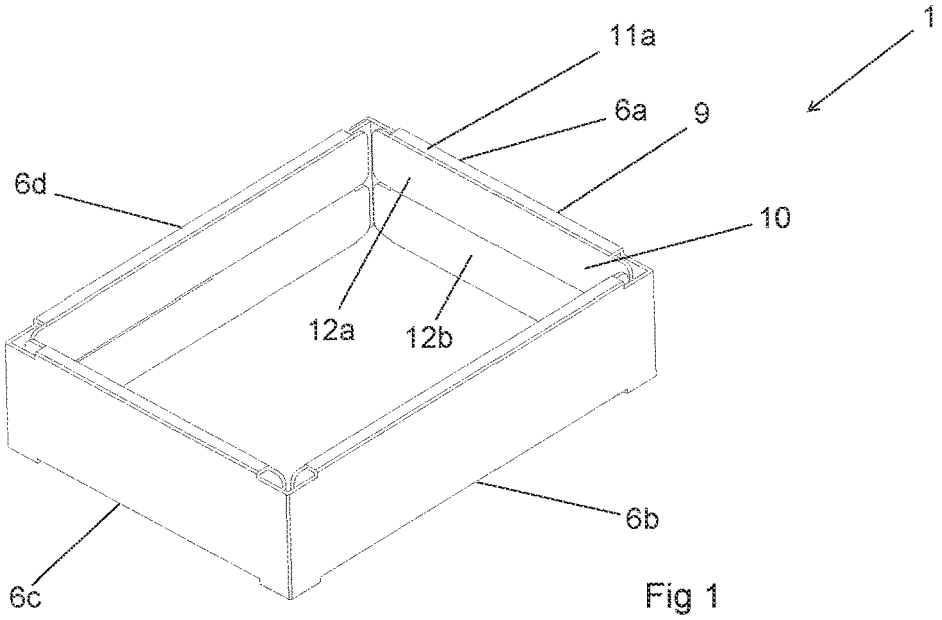
FIG. 1 is a perspective view from above of a pallet collar according to an embodiment of the invention in an assembled state.
Figure 2:
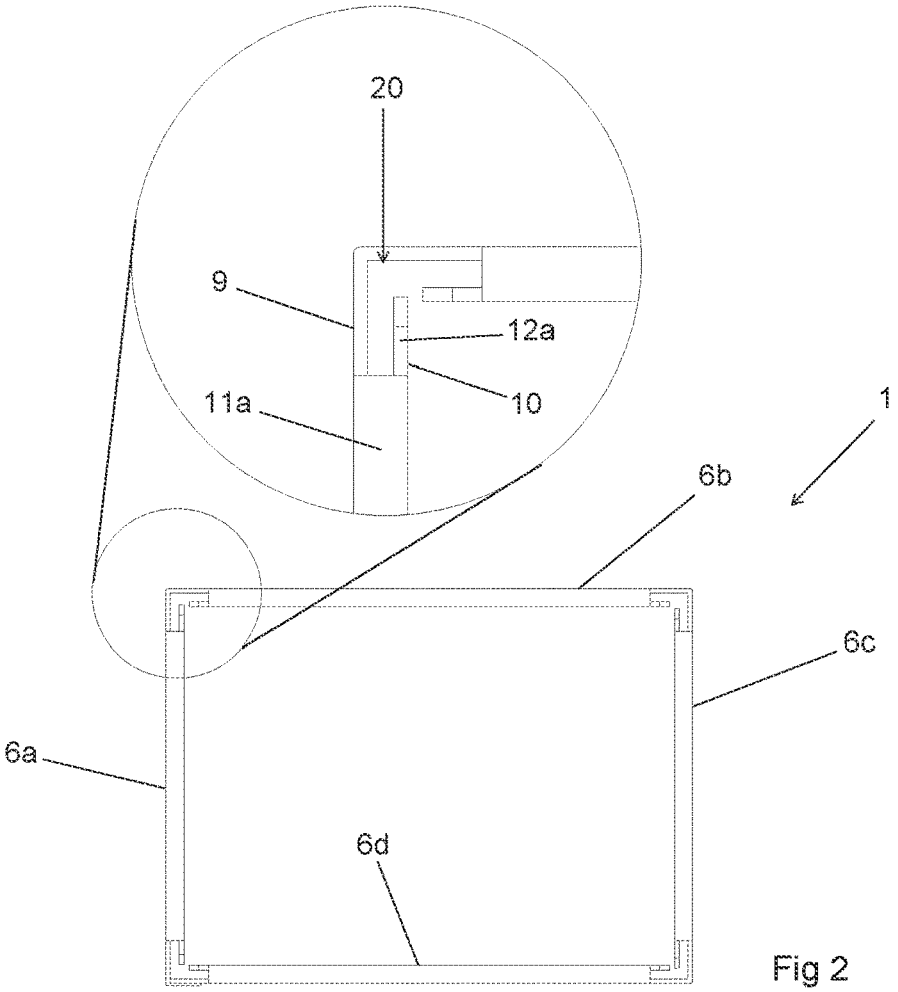
FIG. 2 is a view from above of the pallet collar shown in FIG. 1, including an enlarged view of an upper corner of the pallet collar.

The pallet collar 1 is made of a single paperbased sheet with a uniform thickness, preferably a corrugated cardboard sheet, which is folded along folding lines (8*a-c*, 15*a-b*, 16*a-b*, 17*a-b*, 18*a-b*) to obtain an assembled state of the pallet collar, in which it is shown in FIG. 1. The sheet has four consecutive sections 6*a-d* each having a rectangular or at least substantially rectangular mid part 7*a-d* joined to a mid part of an adjacent section by a main folding line 8*a-c* by making a right angle to that section so that each section 6*a-d* forms a wall of the pallet collar 1 and the main folding lines define outer corners thereof in the assembled state.

Each pallet collar wall has an outer wall portion 9 and an inner wall portion 10 extending in parallel therewith and spaced apart therefrom giving each wall a double wall structure. The outer wall portion 9 of each wall is formed by the mid part 7*a-d* of the section 6*a-d* forming that wall. Each mid part has at each of opposite longitudinal borders thereof as seen in the direction of the extension of said main folding lines 8*a-c* a series of four consecutive parts, namely a first part 11*a-b* located next to the mid part, followed by a second part 12*a-b*, a third part 13*a-b* and lastly a fourth part 14*a-b* located furthest away from the mid part in the order of the series and marking the end thereof.

Between each pair of adjacent ones of the mid part 7*a-d* and the four consecutive parts 11*a-b*, 12*a-b*, 13*a-b*, 14*a-b* of each series there is provided a folding line extending along the adjacent lateral borders of each pair, i.e. perpendicular to the adjacent main folding line/lines 8*a-c*, enabling folding of each one of a said pair relative to the other. More specifically, in each series, there is a first folding line 15*a-b* between the mid part 7*a* and the first part 11*a-b*, a second folding line 16*a-b* between the first part 11*a-b* and the second part 12*a-b*, a third folding line 17*a-b* between the second part 12*a-b* and the third part 13*a-b* as well as a fourth folding line 18*a-b* between the third part 13*a-b* and the fourth part 14*a-b*, in each case dividing the two adjacent parts 7*a-d*, 11*a-b*, 12*a-b*, 13*a-b*, 14*a-b* from each other.

In the assembled state of the pallet collar 1 each part 11*a-b*, 12*a-b*, 13*a-b*, 14*a-b* of each series is folded along the folding line dividing it from the preceding part in the same sense while making a right angle to the preceding part and in the opposite sense with respect to the sense in which the parts of the other series of four consecutive parts of the same section 7*a-d* are folded. This means that in each series, following upon each other, the first part 11*a-b* forms a first spacer between said outer 9 and inner wall portions 10 and a top or bottom edge of the pallet collar wall formed by the section 6*a-d* in which it is included, the second part 12*a-b* extends in parallel with the mid part 7*a-d* and forms half of the inner wall portion 10, to a position in which it is in contact or at least substantially in contact with the second part of the other series of the same section 6*a-d* at the center of the respective pallet collar wall, the third part 13*a-b* extends to an inner side 19 of the mid part 7*a-d* to form a second spacer between said outer 9 and inner wall portions 10, and the fourth part 14*a-b* extends along the inner side 19 of the mid part 7*a-d* and is secured thereto by adhesive, preferably a vinyl acetate polymer based glue.

That all four parts of one series of each section 6*a-d* are folded in "the same sense" and in "the opposite sense" with respect to the sense in which the other series of the same section is folded means that each part of a series is folded in the same direction with respect to the preceding part and in the opposite direction with respect to that in which the other series of the same section is folded. This could be clarified by looking at FIGS. 7 and 8, in which it is clear that a first series of parts 11*a*, 12*a*, 13*a*, 14*a* of the first section 6*a* are folded counterclockwise (one sense) from the mid part 7*a* and the second series of parts 11*b*, 12*b*, 13*b*, 14*b* are folded clockwise (another, opposite sense) from the mid part 7*b*.

Each first 11*a-b* and third 13*a-b* part should have a width measured between its two adjacent folding lines (i.e. for instance between 15*a* and 16*a*; and between 17*a* and 18*a*, respectively) being 2-7 times the thickness of the sheet, more preferably 3-6 times the thickness of the sheet, most preferably 4-5 times the thickness of the sheet, for providing the pallet collar walls with favorable strength properties. The thickness of the sheet could be between 2 mm and 13 mm, between 2 and 9 mm, and is preferably between 3 mm and 7 mm.

For the same reason, each fourth part 14*a-b* should have a width, extending in the direction of the extension of said main folding lines (vertically in FIGS. 7 and 8), being at least 2 times, at least 3 times, preferably at least 4 times the width of each first 11*a-b* and third 13*a-b* part.

All parts 11*a-b*, 12*a-b*, 13*a-b*, 14*a-b* of each series of each section 6*a-d* are centered along the length of the lateral border of the preceding part to which the part is attached, so that a part 12*a-b* with a greater length extends equally far past both outer edges of a part 11*a-b*, 13*a-b* with a relatively smaller length, as seen in the direction of longitudinal extension of the parts. However, it is also possible to provide some or all of the parts with other dimensions than those shown in this example, to give the pallet collar 1 specific and desirable properties. To increase the clarity of the drawings only the parts of the series and folding lines therebetween are referenced to at the first section 6*a*. It should be clear from this description with support from the drawings that the other sections 6*b-d* each has equal parts and folding lines, with corresponding properties and functions as by those of the first section, even though they may have other dimensions.

Each first part 11*a-b* of each pallet collar wall has a length which is smaller than the length of the mid part 7*a-d* of that pallet collar wall and is centered along the length of the mid part so that the ends of each first part are located at a distance from the ends of the mid part to which it is connected and which define the corners of the assembled pallet collar 1, creating an opening 20 into a space 21 between the inner 10 and outer 9 wall portions in each corner of the top and bottom edge of the pallet collar walls, defined by the first parts, in the assembled state of the pallet collar 1. These openings in the corners of the pallet collar enable insertion of separate elements therein which means a possibility to adjust the properties of the pallet collar for a specific use, for instance by inserting stiffening corner elements with different stiffnesses, and also that the pallet collar can be steadily connected to other similar pallet collars, by arranging connecting elements in the corners, to form a strong pallet collar system 2.

Figure 7:
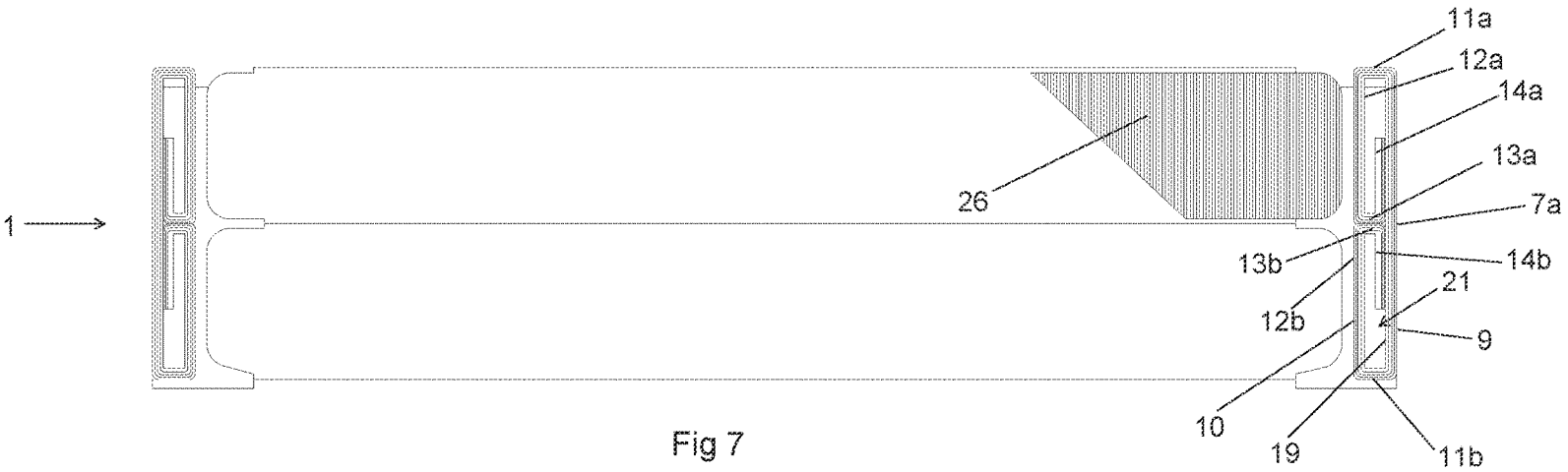
FIG. 7 is a partly sectional side view of a pallet collar as shown in FIG. 1, made of a corrugated cardboard sheet with flutes extending in the direction of the extension of the main folding lines, i.e. vertically in the assembled pallet collar.
Figure 8:
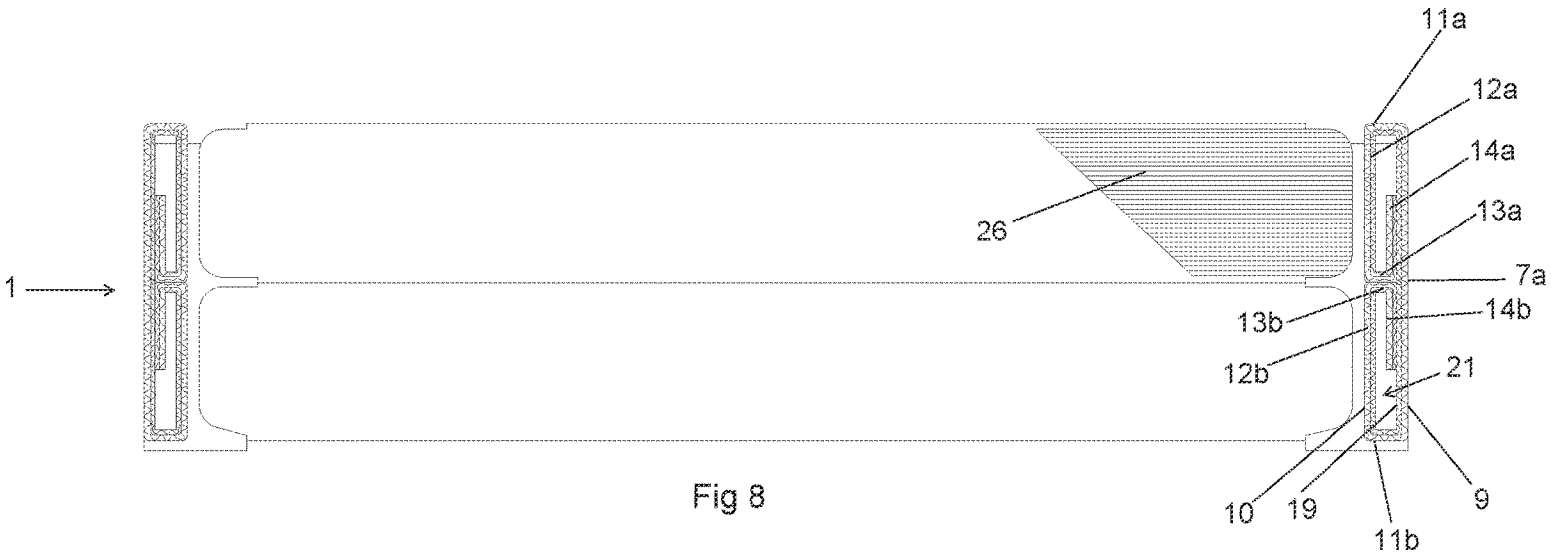
FIG. 8 is a partly sectional side view of a pallet collar as shown in FIG. 1, made of a corrugated cardboard sheet with flutes extending perpendicularly to the direction of the extension of the main folding lines, i.e. horizontally in the assembled pallet collar.
Figure 9:
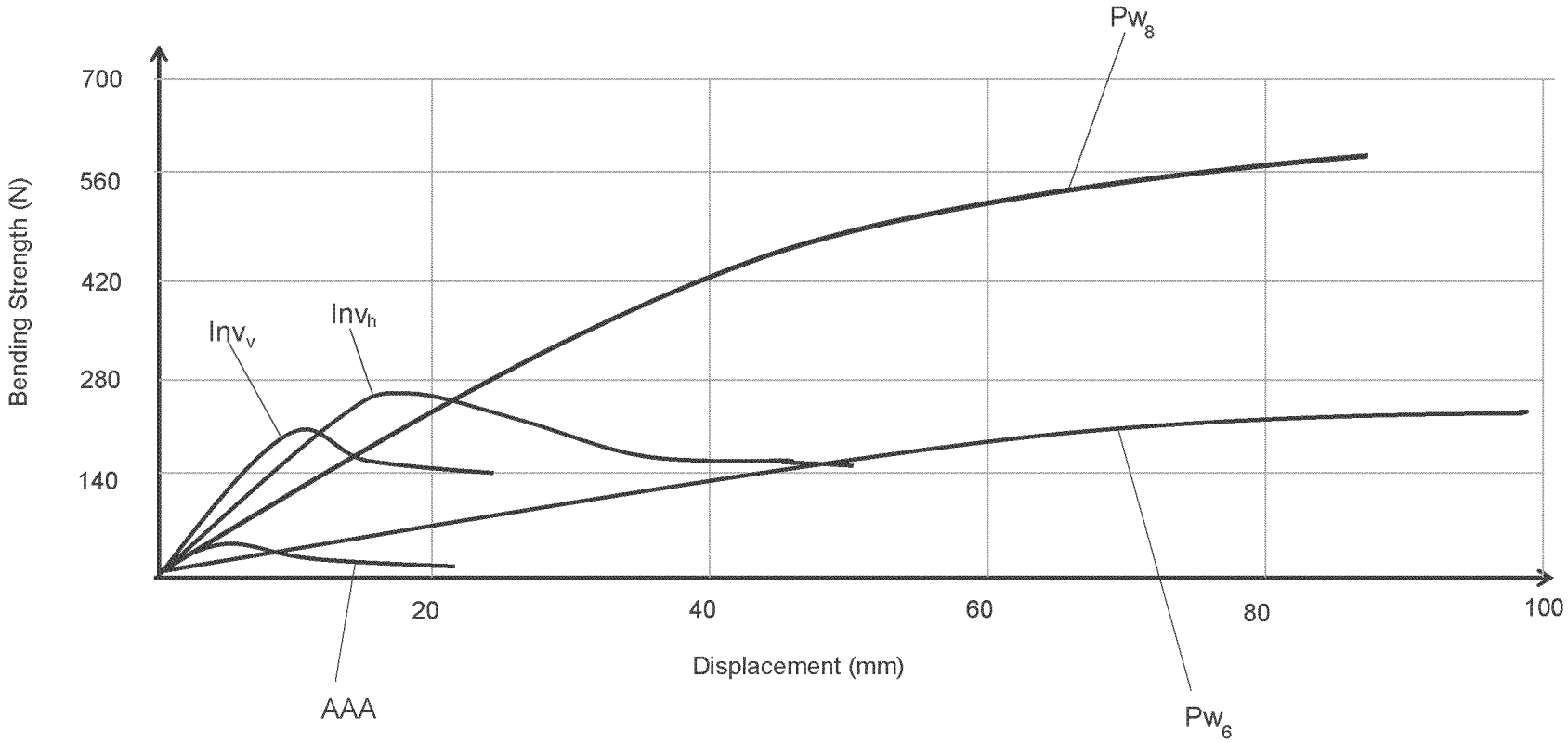
FIG. 9 is a visual presentation of the results from a bending strength test of two pallet collars according to different embodiments of the invention and three pallet collars already known, with different designs and materials.

A further feature of and advantage with the pallet collar 1 according to the invention is the ability to choose the direction of extension of the flutes 26 of the corrugated cardboard sheet to give the pallet collar desirable properties, namely between having the flutes extending in the direction of the extension of the main folding lines 8*a-c*, i.e. vertically in the assembled pallet collar 1, as is shown in FIG. 7, and extending perpendicularly to the direction of the extension of the main folding lines, i.e. horizontally in the assembled pallet collar, as is shown in FIG. 8.

Vertical flutes, which is the design used at pallet collars of this type already known, provides a pallet collar which is stronger against vertically directed forces thereby providing a stacking ability, and weaker against horizontally directed forces. In contrast, horizontal flutes provides a pallet collar which is stronger against horizontally directed forces and weaker against vertically directed forces. By conventional pallet collars used today horizontal flutes is not even an option. The reason is that the pallet collar becomes so weak vertically that it is almost useless even with excellent horizontal strength.

However, the design of the walls of the pallet collar 1 according to the invention allow the use of horizontal flutes, which implies a significant increase in horizontal bending and bulging strength, without loosing the vertical strength and stacking ability. This is made possible through the inventive folding structure of the pallet collar walls providing each wall with two vertically extending wall parts, namely the mid part 7*a* and two second parts 12*a-b* combined, and four horizontally extending wall parts, namely the first parts 11*a-b* and third parts 13*a-b* (see FIG. 7 or 8), giving the walls and thereby the pallet collar 1 a robust structure which is strong in any direction, regardless of flute direction.

This is illustrated in FIG. 9, which shows a presentation of the results of a bending and bulging strength test in which a regular corrugated cardboard pallet collar (AAA) with AAA-flutes, regular pallet collars of poplar plywood with thickness 8 mm (Pw8) and 6 mm (Pw6) as well as pallet collars 1 according to the invention with vertical flutes (Invv) and horizontal flutes Invh) were tested.

It is clear from this test that the pallet collar 1 according to the invention is a strong structure, and in fact both pallet collars according to the invention tested was proven to have a greater bending strength resulting in less bulging than that made of 8 mm poplar plywood by forces applied (laterally at the center of the outer surface of a pallet collar wall) of up to about 250 N.

Hence, a pallet collar 1 is provided which has a more favorable combination of the properties cost, weight and strength with respect to pallet collars already known. This is achieved by the inventive design of the walls of the pallet collar providing this with an excellent strength even though it is produced at a low cost and has a low weight.

Figure 5:
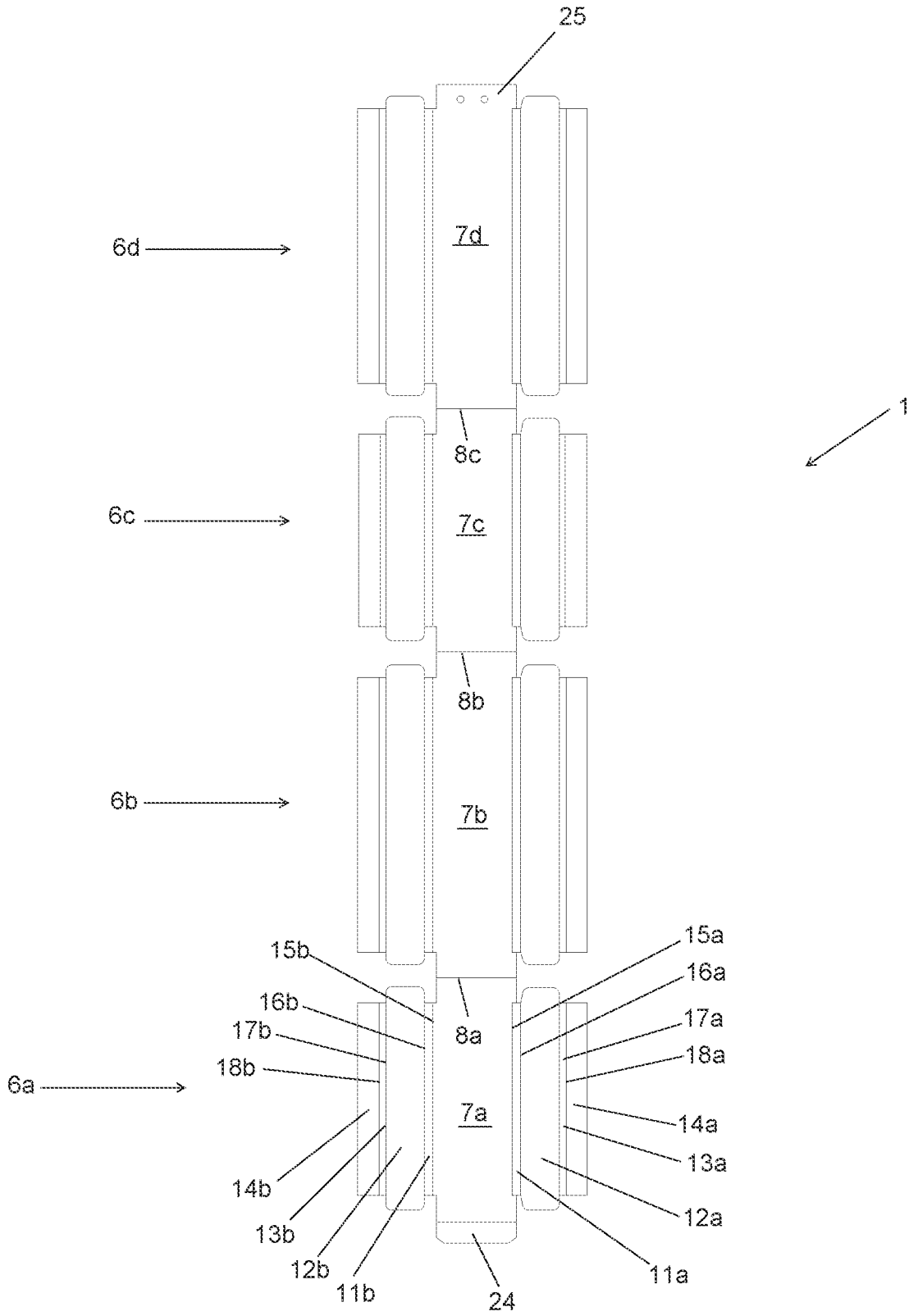
FIG. 5 is a view from above of the pallet collar shown in FIG. 1 in an unassembled state, i.e. as a single flat paper-based sheet with folding lines.
Figure 6:
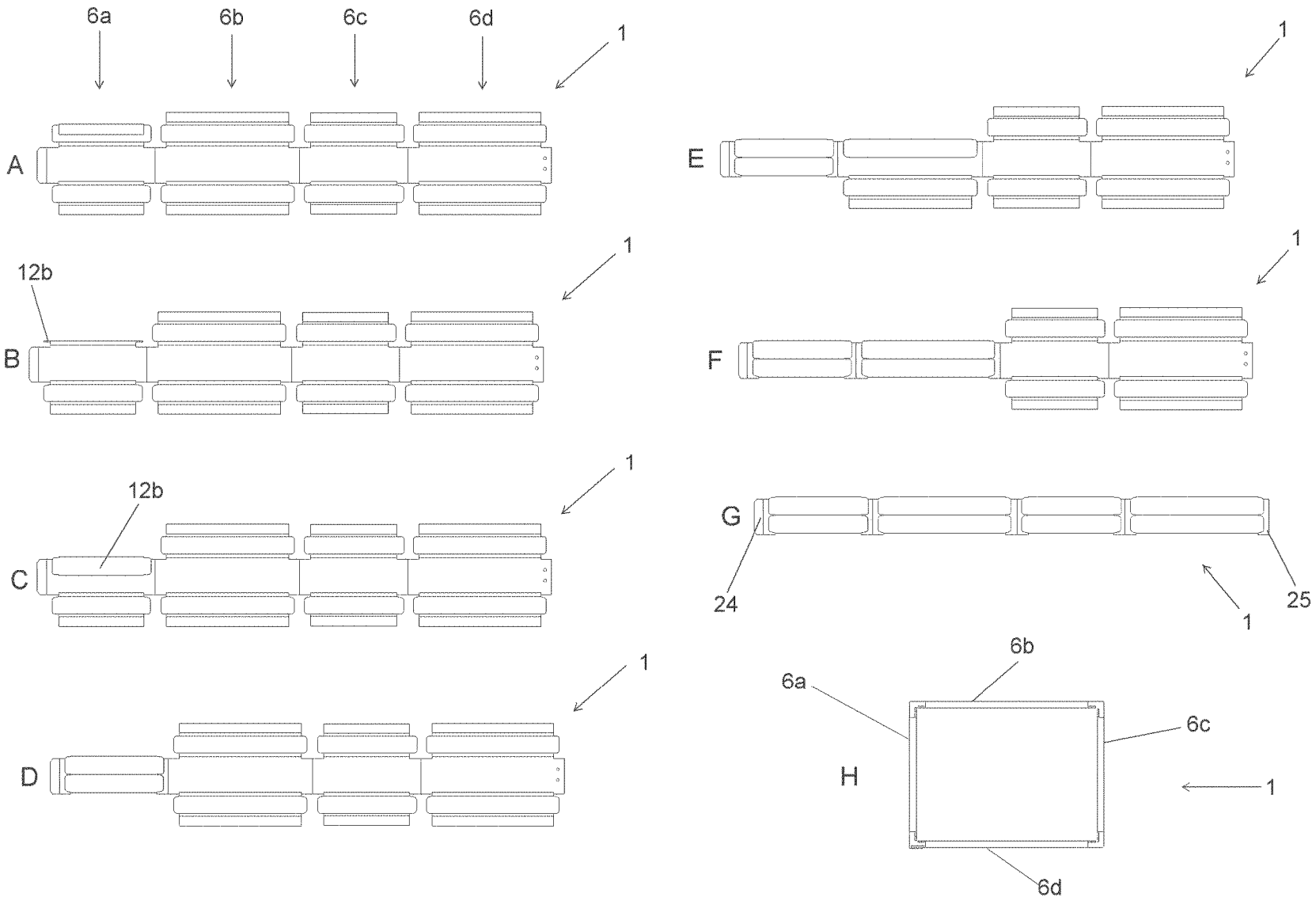
FIG. 6 is a view showing step-by-step (A-H) how the pallet collar shown in FIG. 1 is assembled, i.e. folded from the flat sheet to obtain the assembled state.

Now, it is to be described how a pallet collar 1 according to the invention is assembled, i.e. folded from the single flat paperboard sheet provided with folding lines (8*a-c*, 15*a-b*,

16*a-b*, 17*a-b*, 18*a-b*) as is shown in FIG. 5 to obtain the assembled state, with reference to FIG. 6 in which this process is shown by the snapshot views A-H therefrom.

Firstly, each said series of four consecutive parts 11*a-b*, 12*a-b*, 13*a-b*, 14*a-b* of each section 6*a-d* of the sheet is folded so as to together with the other series and the mid part 7*a-d* of the same section form a wall of the pallet collar 1. As is explained above, each part of each series is folded along the folding line dividing it from the preceding part, i.e. the folding line which precedes it as seen from the mid part, in the same sense while making a right angle to the preceding part, and starting from the outer end of the series with the fourth part 14*a-b*.

View A shows how the fourth part 14*b* and the third part 13*b* of one series of the first section 6*a* has been folded in this way so that the fourth part extends in parallel with the second part 12*b* of that series and the third part extends upwards towards the viewer. View B shows how the second part 12*b* of the series is then folded and extending upwards towards the viewer and view C shows the series after the first part 11*b* thereof has been folded, whereafter the second part 12*b* extends in parallel with the mid part 7*a* forming half of the inner wall portion 10 of the pallet collar wall to be formed by the section.

The opposite other series of the same section is then folded in the same way and a first pallet collar wall has been formed by the first section 6*a* which is shown in view D. Then, this procedure is repeated for the other sections 6*b-c*, illustrated in view E where one series of the second section 6*b* has been folded, in view F where both series of the second section 6*b* has been folded and this section forming a second pallet collar wall, until each series of four consecutive parts of each section has been folded whereby four pallet collar walls have been formed, which is shown in view G.

Thereafter, the sections 6*a-d* are folded towards each other along the main folding lines 8*a-c* so as to each form a right angle with each adjacent section giving the pallet collar a rectangular shape, and the first section 6*a* is then secured to the fourth section 6*d* by gluing or staple a tab 24 projecting from the mid part 7*a* of the first section onto a free end of the mid part 7*d* of the fourth section 6*d*, whereafter the pallet collar 1 is in the assembled state, shown in view H, and ready for use.

A pallet collar system 2 according to an embodiment of the invention is shown in FIGS. 3 and 4. The system comprises three pallet collars 1, 1*a*, 1*b* according to the invention and four elongated corner elements 22 configured to be inserted and received in said space 21 between the outer 9 and inner 10 wall portions at the corners of the pallet collars.

Each corner element 22 has two stiff plate-like parts 23*a-b* interconnected by a flexible portion providing a pivotable movability of the plate-like parts toward and away from each other.

Each corner element is configured to be inserted and received in said space of each of the three pallet collars 1, 1*a*, 1 *b* in mutually associated corners thereof, while extending from a first 1 of the pallet collars out through a said opening 20 thereof, completely through a second 1*a* of the pallet collars, by extending through both opposite openings of the respective corner thereof, and to a third 1*b* of the pallet collars into a said opening thereof, so as to connect these pallet collars with each other (see FIG. 4). Each corner element 22 is configured to be inserted and received in the pallet collars 1, 1*a*, 1*b* with its two plate-like parts forming a right angle with each other so that each plate-like part 23*a-b* in an assembled state of the system 2 is arranged, in each pallet collar, between the inner and outer 9 wall portion of a separate one of two adjacent pallet collar walls of that pallet collar while extending in said space 20 along the respective corner from a bottom region to a top region of the wall.

Hence, a modular pallet collar system 2 which is strong, lightweight and cost effective to produce is facilitated by use of pallet collars according to the invention.

The invention is of course not in any way restricted to the embodiments thereof described above, but many possibilities to modifications thereof will be apparent to a person with ordinary skill in the art without departing from the scope of the invention as defined in the appended claims.

Where it is stated that a component is "connected to" another component, this is to be interpreted as that the components are interconnected directly, or indirectly by an intermediate component.

The terms top, bottom, upper, lower, front, rear, horizontal and vertical as may be used in this disclosure for defining various components, or parts thereof, are to be interpreted as valid for a pallet collar or pallet collar system placed on a horizontal ground, as shown for instance in FIGS. 1 and 3, respectively.

It should be understood that a "single sheet" could also be a sheet composed of a plurality of sheets glued together, and the word single should thus in this disclosure be interpreted as that the sheet is in one single piece in the assembled state of the pallet collar.

That the mid parts of said sections each has a substantially rectangular or rectangular shape means that the main perception of each mid part is a rectangle or the main area of each mid part rectangular, but this may also be provided with rounded corners, as one example.

The wording "at least substantially in contact" in the meaning that each said second part of a said series of a said section extends to a position in which it is in contact or at least substantially in contact with the second part of the other series of the same section should be interpreted as that there may be a very small distance between them, such as up to about 1 times the thickness of the sheet, and this case should still be included in this definition. Also, two said second parts meeting at "the center" of the respective pallet collar wall should be interpreted as that they meet at a center portion, but must not have the exact same dimensions and thereby not meet at the precise center of the wall.

What is claimed is:

1. A pallet collar (1) made of a single paperbased sheet with a uniform thickness, said sheet having four consecutive sections (6*a-d*) each having a substantially rectangular, or rectangular mid part (7*a-d*) joined to a mid part (7*a-d*) of an adjacent section (6*a-d*) by a main folding line (8*a-c*) by making a right angle to that section (6*a-d*) so that each section (6*a-d*) forms a wall of the pallet collar (1), each pallet collar wall having an outer wall portion (9) and an inner wall portion (10) extending in parallel therewith and spaced apart therefrom, the outer wall portion (9) being formed by said mid part (7*a-d*), the mid part (7*a-d*) having at each of opposite borders thereof as seen in the direction of the extension of said main folding line (8*a-c*) a series of four consecutive parts (11*a-b*, 12*a-b*, 13*a-b*, 14*a-b*) each folded along a folding line (15*a-b*, 16*a-b*, 17*a-b*, 18*a-b*) perpendicular to said main folding line (8*a-c*) in the same sense while making a right angle to the preceding part (11*a-b*, 12*a-b*, 13*a-b*, 14*a-b*) and in the opposite sense with respect to the sense in which the parts (11*a-b*, 12*a-b*, 13*a-b*, 14*a-b*) of the other series of four consecutive parts (11*a-b*, 12*a-b*, 13*a-b*, 14*a-b*) are folded, so that following upon each other a first part (11*a-b*) of each series next to said mid part (7*a-d*) forms a first spacer between said outer (9) and inner (10) wall portions, a second part (12*a-b*) extends in parallel with the mid part (7*a-d*) and forms half of the inner wall portion (10), to a position in which it is substantially in contact with the second part (12*a-b*) of the other series at the center of the respective pallet collar wall, a third part (13*a-b*) extends to an inner side (19) of the mid part (7*a-d*) to form a second spacer between said outer (9) and inner (10) wall portions, and a fourth part (14*a-b*) extends along the inner side (19) of the mid part (7*a-d*) and is secured thereto.

2. A pallet collar (1) according to claim 1, wherein each first (11*a-b*) and third (13*a-b*) part has a width measured between its two adjacent folding lines (15*a-b*, 16*a-b*, 17*a-b*, 18*a-b*) being 2-7 times the thickness of the sheet, more preferably 3-6 times the thickness of the sheet, most preferably 4-5 times the thickness of the sheet.

3. A pallet collar (1) according to claim 1 or 2, wherein each fourth part (14*a-b*) has a width, extending in the direction of the extension of said main folding lines (8*a-c*), being at least 2 times, at least 3 times, preferably at least 4 times the width of each first (11*a-b*) and third (13*a-b*) part measured between its two adjacent folding lines (15*a-b*, 16*a-b*, 17*a-b*, 18*a-b*).

4. A pallet collar (1) according to claim 1, wherein the second parts (12*a-b*) of each pallet collar wall extends into contact with each other at the center of the pallet collar wall.

5. A pallet collar (1) according to claim 1, wherein at least one first part (11*a-b*) of each pallet collar wall has a length which is smaller than the length of the mid part (7*a-d*) of that pallet collar wall and is centered along the length of the mid part (7*a-d*) so that the ends of said first part (11*a-b*) are located at a distance from the ends of the mid part (7*a-d*) to which it is connected, creating an opening (20) into a space (21) between the inner (10) and outer (9) wall portions in each corner of the top and/or bottom edge of the pallet collar walls, defined by the first parts (11*a-b*), in an assembled state of the pallet collar (1), to allow insertion of a separate element (22) into said space (21) at said corners of the pallet collar (1).

6. A pallet collar (1) according to claim 5, wherein each first part (11*a-b*) of each pallet collar wall has a length which is smaller than the length of the mid part (7*a-d*) of that pallet collar wall and is centered along the length of the mid part (7*a-d*) so that the ends of each first part (11*a-b*) are located at a distance from the ends of the mid part (7*a-d*) to which it is connected, creating said opening (20) in each corner of the top and bottom edge of the pallet collar walls, in the assembled state of the pallet collar (1), so as to allow a separate element (22) to project through the pallet collar (1) at each corner thereof.

7. A pallet collar (1) according to claim 1, wherein the paperbased sheet is a fiberboard sheet.

8. A pallet collar (1) according to claim 7, wherein the fiberboard sheet is a corrugated cardboard sheet.

9. A pallet collar (1) according to claim 8, wherein the flutes (26) of the corrugated cardboard sheet extend in the direction of the extension of said main folding lines (8*ac*).

10. A pallet collar (1) according to claim 8, wherein the flutes (26) of the corrugated cardboard sheet extend perpendicularly to the direction of the extension of said main folding lines (8*a-c*).

11. A pallet collar (1) according to claim 1, wherein each fourth part (14*a-b*) is secured to the mid part (7*a-d*) of the same pallet collar wall by adhesive, preferably a vinyl acetate polymer based glue.

12. A pallet collar system (2) comprising at least two pallet collars (1, 1*a*, 1*b*) according to claim 5, and at least one, preferably four, elongated corner elements (22), each configured to be inserted and received on one hand in said space (21) of a first of the pallet collars (1, 1*a*, 1*b*) in a corner thereof and on the other hand in said space (21) of a second of the pallet collars (1, 1*a*, 1*b*) in an associated corner thereof, while extending between and through said opening (20) in each of the pallet collars (1, 1*a*, 1*b*), so as to connect these pallet collars (1, 1*a*, 1*b*) with each other.

13. A pallet collar system (2) according to claim 12, wherein the system (2) comprises at least three such pallet collars (1, 1*a*, 1*b*), which have the features of each first part (11*a-b*) of each pallet collar wall having a length which is smaller than the length of the mid part (7*a-d*) of that pallet collar wall and is centered along the length of the mid part (7*a-d*) so that the ends of each first part (11*a-b*) are located at a distance from the ends of the mid part (7*a-d*) to which it is connected, creating said opening (20) in each corner of the top and bottom edge of the pallet collar walls, in the assembled state of the pallet collar (1), to allow a separate element (22) to project through the pallet collar (1) at each corner thereof, and each elongated corner element (22) is configured to be inserted and received in said space (21) of said at least three pallet collars (1, 1*a*, 1*b*) in mutually associated corners thereof, while extending from a first (1) of the pallet collars out through said opening (20) thereof, completely through a second (1*a*) of the pallet collars, by extending through both opposite openings (20) of the respective corner thereof, and to a third (1*b*) of the pallet collars into said opening (20) thereof, to connect these pallet collars (1, 1*a*, 1*b*) with each other.

14. A pallet collar system (2) according to claim 12, wherein each of said at least one elongated corner element (22) has two stiff plate-like parts (23*a-b*) interconnected by a flexible portion, each plate-like part (23*a-b*) being in an assembled state of the system (2) configured to be arranged, in each pallet collar (1, 1*a*, 1*b*), between the inner (10) and outer (9) wall portion of a separate one of two adjacent pallet collar walls of that pallet collar (1, 1*a*, 1*b*) while extending in said space (21) along the respective corner from a bottom region to a top region of the wall.

15. A pallet collar (1) according to claim 1 and configured for storing and/or shipping goods on a pallet (3).

* * * * *